United States Patent [19]

McGregor

[11] Patent Number: 4,884,389

[45] Date of Patent: Dec. 5, 1989

[54] ROTATING CAROUSEL AND BAG HANDLING APPARATUS FOR PAPER OR PLASTIC BAGS

[76] Inventor: Harold R. McGregor, 1444 Lincoln Ave., Owatonna, Minn. 55060

[21] Appl. No.: 242,545

[22] Filed: Sep. 12, 1988

[51] Int. Cl.[4] ..... B65B 43/18

[52] U.S. Cl. ..... 53/571; 141/114; 414/733; 414/795.8; 414/797; 414/923

[58] Field of Search ..... 53/571, 573, 570, 168; 198/475.1, 797, 468.4; 414/795.8, 923, 796.9, 797, 733, 796.4; 141/114

[56] References Cited

U.S. PATENT DOCUMENTS

| | | | |
|---|---|---|---|
| 3,945,173 | 3/1976 | Buzzl | 53/571 |
| 4,030,528 | 6/1977 | Horning | 141/114 X |
| 4,310,037 | 1/1982 | Seals | 53/571 X |
| 4,411,296 | 10/1983 | Durant | 53/571 X |
| 4,451,191 | 5/1984 | Torre | 414/796.9 X |
| 4,612,965 | 9/1986 | McGregor | 53/571 X |
| 4,735,539 | 4/1988 | Häkkinen et al. | 414/797 X |

*Primary Examiner*—James F. Coan
*Attorney, Agent, or Firm*—Moore & Hansen

[57] ABSTRACT

A rotating carousel and bag handling apparatus comprising a rotating carriage plate driven by a motor and carrying a plurality of trays filled with bags. The trays are each maintained in a stable, level position by a timing collar, belt, and pulley assembly connected to each tray. As successive bag trays are rotated to a pickup position adjacent a bag handling mechanism, a brake assembly momentarily stops the motion of the bag carousel sufficient for a bag handling arm to pivot down over one of the bag trays, and for a plurality of bag grippers to grip and hold the top bag in that tray. The bag handling arm then pivots back upwardly and away from the tray carrying the bag onto a bag support assembly displaced over the conveyor belt and mounted on a pair of rocker arms, with the longitudinal edge of the bag being positioned adjacent to a side retaining wall on the conveyor belt. As the bag is released, the rocker arms and bag support assembly pivot away from the side retaining wall of the conveyor belt, allowing the bag to slide off the bag support assembly and lay flat on the conveyor belt in a spaced-apart or overlapping relationship to a previously transferred bag.

20 Claims, 3 Drawing Sheets

ROTATING CAROUSEL AND BAG HANDLING APPARATUS FOR PAPER OR PLASTIC BAGS

BACKGROUND OF THE INVENTION

This invention relates generally to automated bag handling and filling machines, and particularly to an apparatus for transferring paper or plastic bags from a rotating supply carousel to a conveyor belt leading to a filling station.

Machines particularly designed for the task of hanging plastic or paper bags on a spout in an automated filling station are well known to the art, as are the various support devices used for supplying bags to the hanging machines from a bag magazine, tamping and weighing the contents of the bags, and conveying the filled bags to a sealing or loading station.

Improvements have been made both in the design of the bag magazines themselves, and the machines which remove individual bags from the magazines and transport them to a hanging machine or directly to a filling spout.

It has generally been accepted that for optimal performance, a single bag handling apparatus designed for use with a particular bag type or structure is best utilized, although many bag handling machines have incorporated some degree of adjustability or flexibility to accommodate bags of slightly varying size, weight, or material:

However, because of the vast differences in bag structures and the peculiar constraints of various bag hanging and filling machines, the rate at which bags are to be filled, the material being placed in the bags and the process used for filling, it is a common practice to design a complete bag handling facility including a magazine, transport mechanism, and bag hanging apparatus around a given filling machine and bag type:

U.S. Pat. No. 4,310,037 discloses a system of four rotating bag pickup and release mechanisms designed to remove a gussetted and valved bag from a magazine and transport the bag to a set of pinch rollers used in filling the bag. While disclosing the concept of a rotary bag delivery system, the apparatus described in the '037 patent is not suitable for use with varying types paper or plastic bags, is incapable of delivering those bags to a horizontal conveyer belt, and must function at a relatively high rate of speed to be operable.

U.S. Pat. No. 4,612,965 discloses an apparatus having a pivoting arm and suction grippers for folding the top edge of a bag away from a magazine such that the bag may be removed from the magazine by a pair of gusset grippers attached to a bag hanging mechanism, and a pivoted arm member and suction grippers to position the top portion of a flexible bag such that it may be gripped by a bag hanging mechanism. While disclosing the concept of employing a pivoting arm member and suction grippers to position the top portion of a flexible bag such that it may be gripped by a bag hanging mechanism, and a system which may be operated effectively at slower speeds, the apparatus described in the '965 patent does not serve to place the bag on a conveyor belt, does not function interchangeably with various plastic or paper bags, uses a specially designed magazine having narrower tolerances, and requires a more complex pneumatic control system and array of pivoting arms and movable parts.

BRIEF SUMMARY OF THE INVENTION

It is therefore one object of this invention to design a rotating carousel and bag handling apparatus which may be used to accurately transfer bags from a supply source to a predetermined position on a linearly moving conveyor belt.

It is another object of this invention to design the above rotating carousel and bag handling apparatus such that it may remove bags from a supply and may be continuously replenished without interrupting the operation of the machine.

It is an additional object of this invention to design the above rotating carousel and bag handling apparatus such that it may be used with a diverse array of paper and plastic bags.

It is a related object of this invention to design the above rotating carousel and bag handling apparatus such that it may be rapidly and easily adjusted to accommodate a variety of bag sizes and types.

It is yet another object of this invention to design the above rotating carousel and bag handling apparatus such that it may be operated at varying speeds, and deposit those bags on the conveyor belt in either a spaced apart or overlapping configuration.

It is a distinct object of this invention to design the above rotating carousel and bag handling apparatus such that the timing or synchronization of the interrelated motions of the various moving components of the bag handling mechanism may be achieved through the mechanical interconnection of those systems.

Briefly described, the rotating carousel and bag handling apparatus of this invention comprises a rotating carriage plate driven by a motor and carrying a plurality of trays filled with bags. The trays are each maintained in a stable, level position by a timing collar, belt, and a pulley assembly connected to each tray and operating in combination with the rotating carriage plate.

As each successive bag tray is rotated to a pickup position adjacent a bag handling mechanism, a brake assembly momentarily stops the motion of the bag carousel sufficient for a bag handling arm to pivot down over the bag tray, and for a plurality of bag grippers to grip and hold the top bag in the tray. The bag handling arm then pivots back upwardly and away from the tray carrying the bag therewith.

The bag handling arm releases the bag onto a bag support assembly displaced over the conveyor belt and mounted on a pair of rocker arms, with the longitudinal edge of the bag adjacent to a side retaining wall on the conveyor belt. As the bag is released, the rocker arms and bag support assembly pivot away from the side retaining wall of the bag support assembly to create a reciprocatory scissoring action which is repeated as bags are transported from the carousel and placed on the conveyor belt.

DESCRIPTION OF THE PREFERRED EMBODIMENTS

The rotating carousel and bag handling apparatus of this invention is shown in FIGS. 1–8 and referenced generally therein by the numeral 10.

Figure 1:
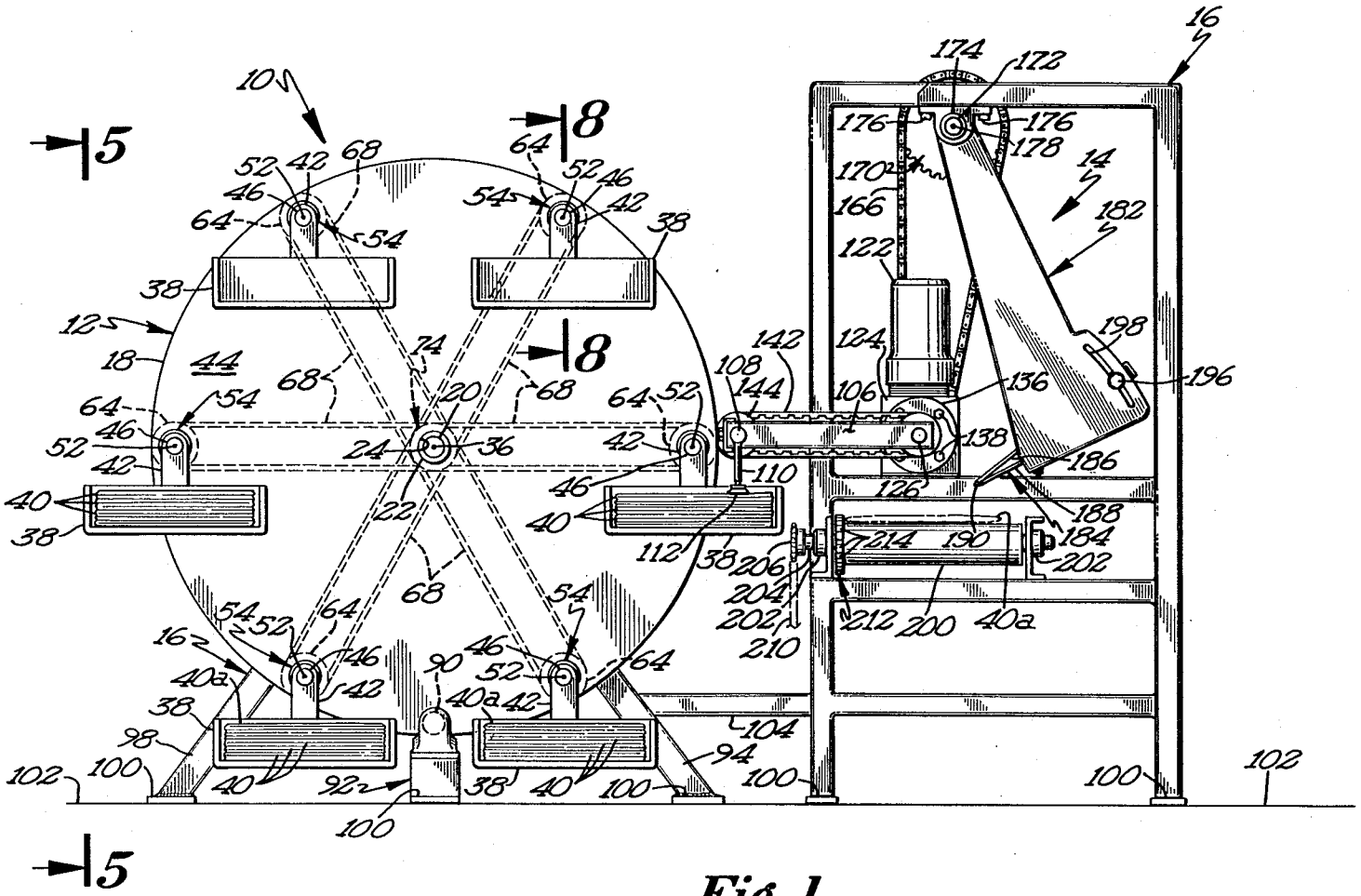
FIG. 1 is a side elevation view of the rotating carousel and bag handling apparatus of this invention.

Referring to FIG. 1, it may be seen that the rotating carousel and bag handling apparatus 10 of this invention comprises a rotating carousel assembly 12 and an associated bag handling mechanism 14 each mounted on and interconnected by a common structural frame assembly 16 constructed of heavy gauge rectangular steel tubing sections or beams which are welded or bolted together.

Figure 7:
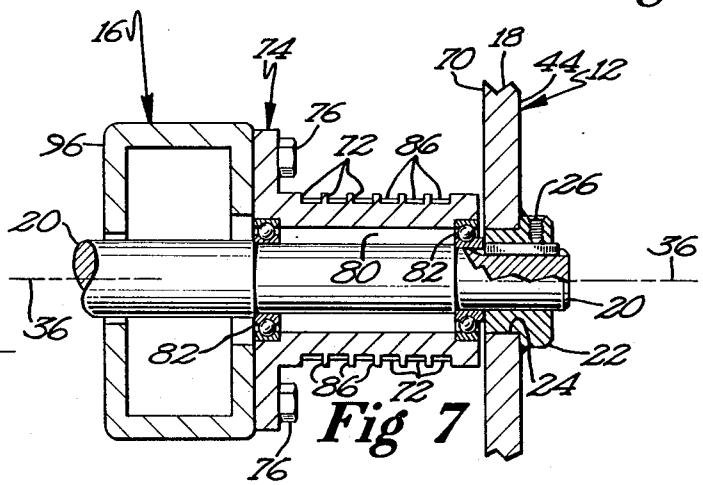
FIG. 7 is a cross-section view of the timing belt assembly of the bag carousel of FIG. 1 taken through line 7—7 in FIG. 5.

The carousel assembly 12 comprises a large circular carriage plate 18 rotatably mounted on a carriage axle 20 and hub member 22 which extend through a central aperture 24 defined by the carriage plate 18 as shown in FIG. 7. The hub member 22 may be attached or fastened to the carriage plate 18 by welding or other suitable fastening means, with the hub member 22 being fastened to the carriage axle 20 by one or more threaded fasteners 26 received within cooperatingly threaded bores 28 such that the threaded fasteners 26 contact and engage the surface of the carriage axle 20 to hold the hub member 22 and carriage plate 18 in place, and such that the threaded fasteners 26 may be loosened to permit the carriage plate 18 and hub member 22 to be removed from the carriage axle 20 for maintenance.

Figure 5:
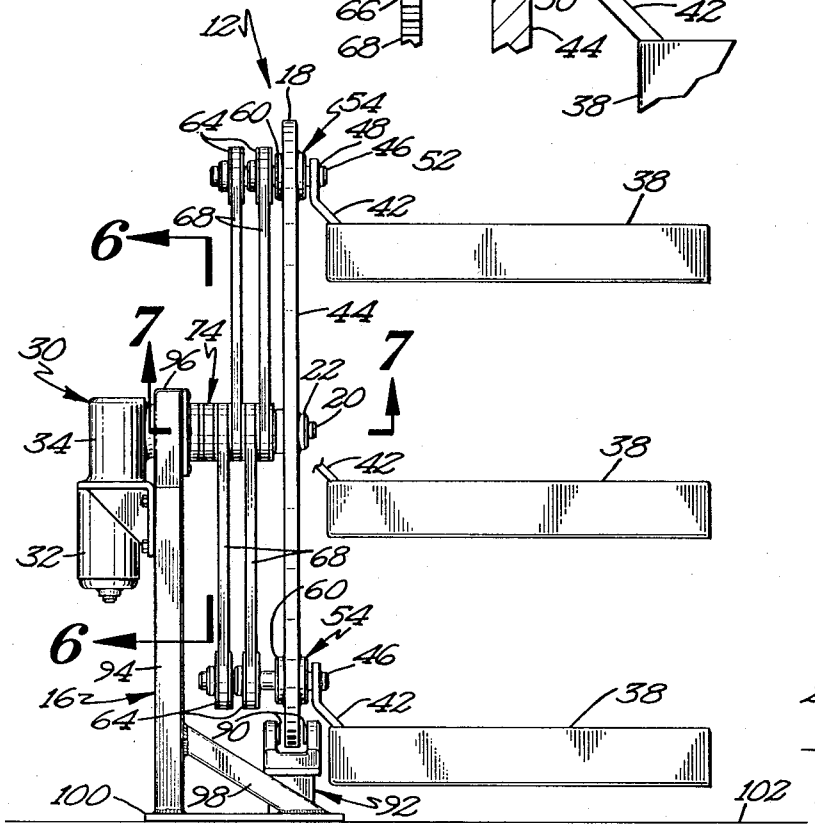
FIG. 5 is a side elevation view of the bag carousel of Figure 1.

Referring particularly to FIGS. 5 and 7, it may be seen that the carriage axle extends rearwardly through the hub member 22 and carriage plate 18, a section of the supporting frame assembly 16, and into a drive assembly 30. The drive assembly 30 consists essentially of a drive motor 32 and a differential mechanism 34 for translating the rotation of the drive motor 32 into rotation of the carriage axle 20 around an axis of rotation 36. Any combination of drive motor 32 and differential mechanism 34 well known to the art may be employed, the most suitable drive assembly 30 depending upon the torque which must be exerted upon the carriage axle 20 in order to rotate the carriage plate 18 and other components associated with the carousel assembly 12, and the angular velocity of the carousel assembly 12 desired to act in cooperation with the bag handling mechanism 14 as described in detail below.

Referring to FIGS. 1 and 5, it may be seen that a plurality of generally rectangular bag trays 38 are mounted to and carried on the carriage plate 18. Each tray 38 may support and contain a plurality of bags 40, the shape and structure of the bags 40 depending primarily on the type of product being placed within each bag 40 and the design of the filling mechanism (not shown).

Figure 8:
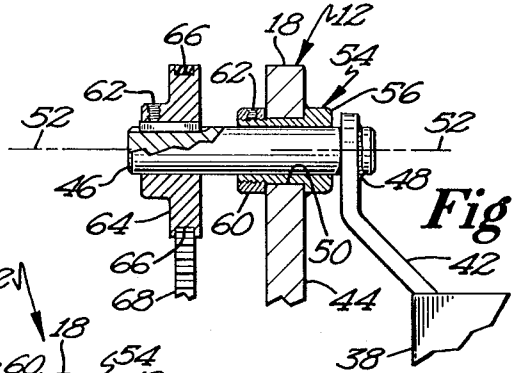
FIG. 8 is a partial cross-section view of the bag tray of the bag carousel taken through line 8—8 in FIG. 1.

Referring to FIGS. 5 and 8, it may be seen that each bag tray 38 includes an upwardly extending angled tang member 42 which supports the bag tray 38 and additionally displaces the tray 38 from the front planar surface 44 of the carriage plate 18. Each tang member 42 is fixedly mounted on a tray axle 46 which extends through an aperture 58 in the tang member 42 and is fastened thereto by welding or other suitable means. Each tray axle 46 similarly extends through an aperture 50 in the carriage plate 18, and is mounted so as to rotate freely therein about an axis of rotation 52. Each tray axle 46 is received at least partially within a retaining collar 54 through the aperture 50 in the carriage plate 18 and defines a central bore 58 sized to slidingly and rotatable accommodate the tray axle 46, with a locking ring 60 which is threaded onto the one end of the elongated main body section 56 of the retaining collar 54 and fastened thereto with a threaded fastener 62 such that the locking collar 54 may be removed from the aperture 50 of the carriage plate 18.

Attached to each of the tray axles 46 on the rear side of the carriage plate 18 opposing the bag trays 38 is a timing pulley 64. Each timing pulley 64 defines a channel 66 to receive a flexible, continuous loop timing belt 68 therein, with the channel 66 of each timing pulley 64 being spaced a distance away from the rear planar surface 70 of the carriage plate 18 such that no two timing belts 68 overlap in a longitudinal direction generally parallel with and co-extensive along the length of the carriage axle 20.

Figure 6:
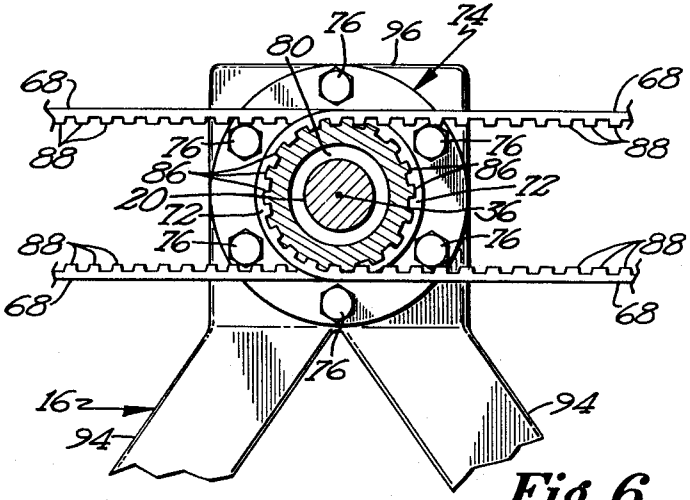
FIG. 6 is a partial cross-section view of the timing belt assembly of the bag carouse 1 of FIG. 1 taken through line 6—6 in FIG. 5.

The opposing end of each timing belt 68 is received within one of a series of corresponding channels 72 defined by the outer surface of a cylindrical timing collar 74 positioned between the rear surface 70 of the carriage plate 18 and the frame assembly 16 and encircling the carriage axle 20 on which the carriage plate 18 is mounted, as shown in FIGS. 6 and 7. The timing collar 74 is fastened to the frame assembly 16 with a plurality of threaded fasteners 76 which extend through aligned apertures in a rear flange section 78 of the timing collar 74 and the frame assembly 16. The timing collar 74 defines a central bore 80 through which the carriage axle 20 extends, and encloses a pair of ring bearing assemblies 82 which contact the carriage axle 20 and permit the carriage axle 20 and carriage plate 18 to rotate with minimal friction while being supported by the timing collar 74 and frame assembly 16.

The channels 72 in the timing collar 74 define a number of teeth-like projections 86 which are spaced apart and engage similarly spaced corresponding projections 88 on the inner surface of the timing belts 68. These interlocked projections 86, 88 on the timing collar 74 and timing belts 69 ensure that as the carriage plate 18 and bag trays 38 rotate through a given arc, the bag trays 38 and tray axle 46 maintain a constant angular orientation relative to the frame 16. That is, a vertical line bisecting any one of the tray axles 46 and intersecting a particular point on the top surface of the tray axle 46 at a given moment will remain vertically oriented and intersect at the same point as the carriage axle 20 and carriage plate 18 rotate through an entire revolution. In this manner, since each tang member 42 is fixedly connected to the associated tray axle 46 and bag tray 38, each bag tray 38 will remain level and horizontally oriented in an upright position as the carriage axle 20 and carriage plate 18 rotate through an entire revolution. The bag trays 38 are preferably maintained in a generally horizontal position as shown in FIG. 1.

Although the direction and extent of rotation imparted to the carriage axle 20 and carriage plate 18 may be controlled by the drive assembly 30, it has proven preferable to employ a braking system comprising a pair of opposing brake pads 90 which may be urged into frictional contact with the front and rear planar surfaces 44, 70 of the carriage plate 18 in response to a control signal generated when the bag trays 38 are located in a predetermined position. The brake pads 90 may be constructed of any suitable rubber, plastic, or felt material capable of securely gripping the surfaces 44, 70 of the carriage plate 18, and are mounted in a brake clamping assembly 92 which utilizes any conventional pneumatic, hydraulic, or mechanical drive mechanism to exert a clamping force with the brake pads 90 on the carriage plate 18.

The frame assembly 16 supporting the bag carousel 12 includes a pair of angled leg members 94 supported in a vertical position as shown in FIG. 5 by one or more leg braces 98, the leg braces 98 and leg members 94 being welded or otherwise attached to one or more foot pads 100 to provide stability to the bag carousel 12, and permit the frame members 16 to be attached to a floor or other supporting surface 102.

Referring particularly to FIGS. 1–4, the bag handling mechanism 14 is shown in position adjacent to the bag carousel 12 described above. The bag handling mechanism 14 is connected to and held a constant distance from the frame assembly 16 supporting the bag carousel 12 by an intermediate frame member 104, with the bag handling mechanism 14 being supported by the corresponding section of the frame assembly 16 similar in design to that associated with the bag carousel 12.

Figure 4:
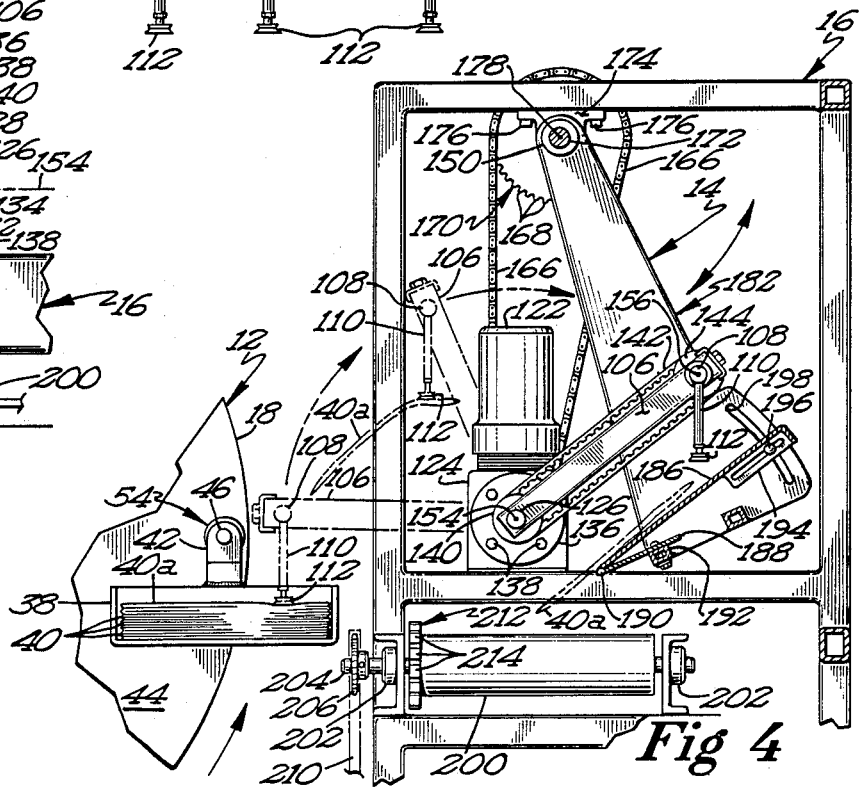
FIG. 4 is a side elevation view of the bag handling mechanism of FIG. 1 showing the pivoting bag handling arm at various positions in phantom.

Referring to FIGS. 1 and 4, it may be seen that as a bag tray 38 passes at the closest point to the bag handling mechanism 14, a pivotable bag handling arm 106 may be pivoted downwardly to a generally horizontal bag pickup position adjacent to and partially overlying the bag tray 38.

Figure 2:
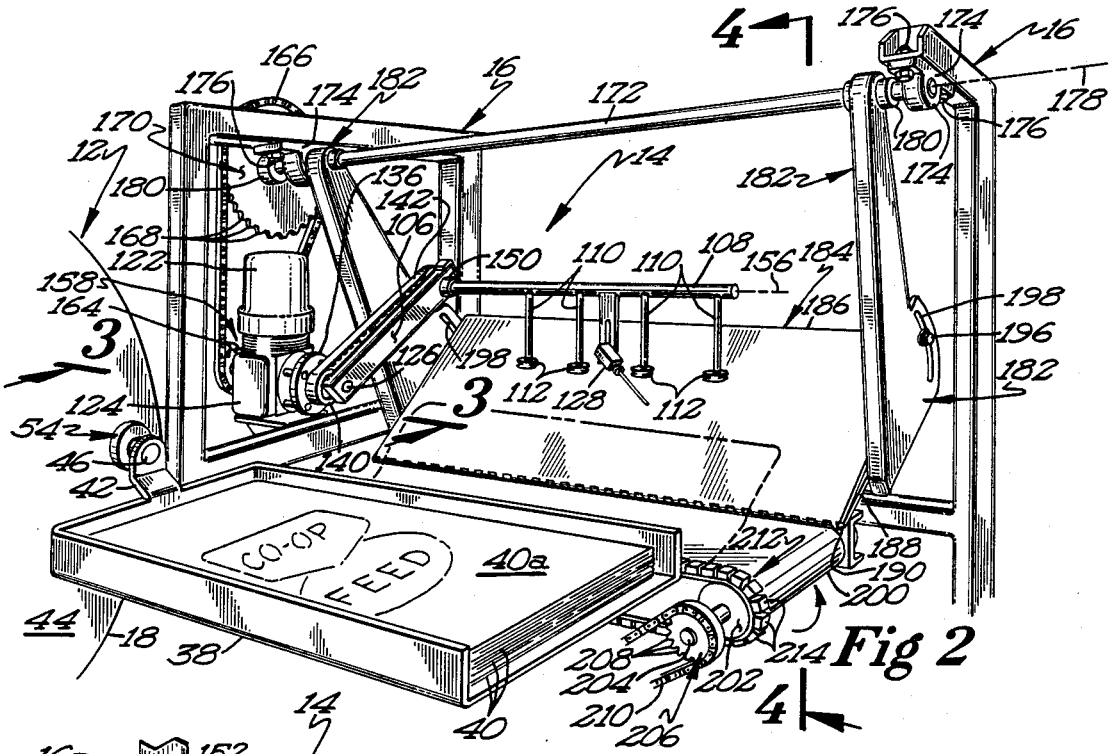
FIG. 2 is a partial perspective view of the bag handling mechanism and bag tray of the rotating carousel and bag handling apparatus of FIG. 1.
Figure 3:
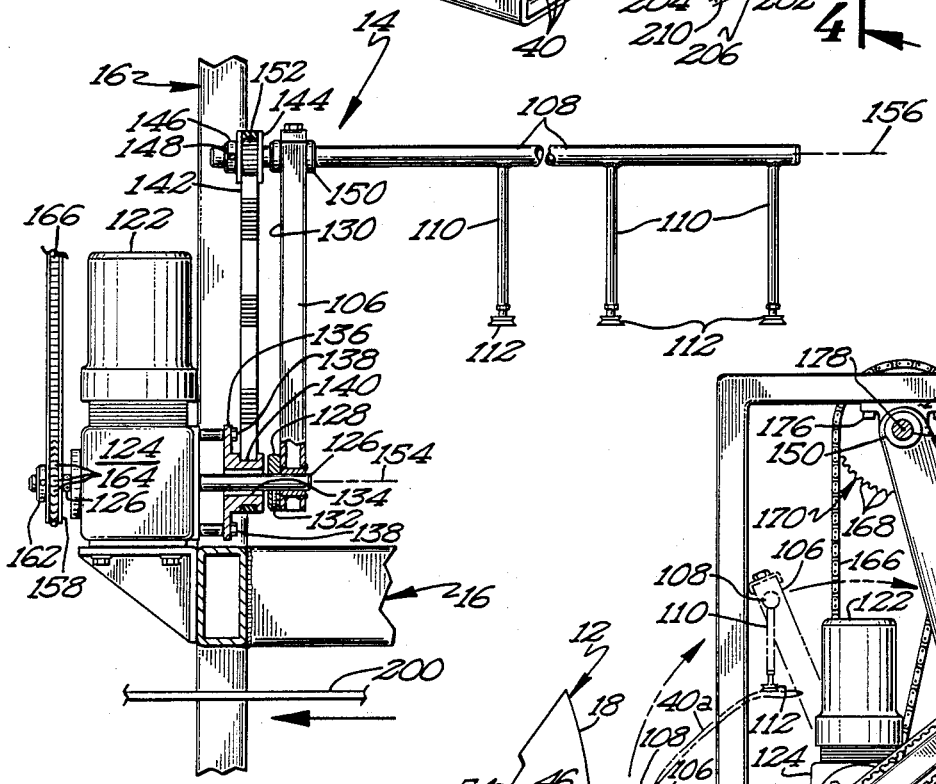
FIG. 3 is a partial cross-section view of the bag handling mechanism taken through line 3—3 in FIG. 2.

Referring to FIGS. 2 and 3, it may be seen that extending outwardly toward the front from the bag handling arm 106 is a gripper support arm 108 which traverses substantially the length of each of the bags 40. Depending from the gripper support arm 108 are four spaced-apart gripper fingers 110 each having a suction cup or bag gripper 112 constructed of a flexible plastic or rubber material attached thereto.

Also depending from the gripper support arm 108 is a switch support bracket 114 having a longitudinal aperture 116 and a reed or whisker-type switch 118 attached thereto by a threaded fastener (not shown) such that the switch 118 may be adjusted to varying angles and positions along the length of the switch support bracket 114. The switch 118 has a long probe or whisker 120 which extends from the switch 118, with the switch 118 either completing or interrupting an electrical circuit when the probe 120 touches an object and is displaced angularly or longitudinally.

Each bag gripper 112 is connected to a source of vacuum pressure (not shown) which produces a suction or vacuum force in the bag gripper 112 which may be either initiated or terminated responsive to an electrical signal from the switch 118.

The bag handling arm 106 is driven through a range of pivotable reciprocatory motion by a drive motor 122 coupled to the bag handling arm 106 by a reciprocating differential 124 and a drive shaft 126. Referring to FIG. 3, it may be seen that the drive shaft 126 is fixedly coupled to the bag handling arm 106 by a locking collar 128 which is securely fastened to the rear surface 130 of the bag handling arm 106, and a threaded fastener 132 which extends through the locking collar 128 and engages the outer surface of the drive shaft 126.

The drive shaft 126 also extends through and may rotate freely within a cylindrical bore 134 defined by a gripper timing collar 136 which is situated between the differential 124 and the bag handling arm 106 and fastened to the housing of the differential 124 by threaded fasteners 138 such as bolts. The gripper timing collar 136 defines a recessed channel 140 which receives a continuous loop timing belt 142. The end of the timing belt 142 opposing the gripper timing collar 136 an drive shaft 126 encircles a gripper timing pulley 144 which is mounted on the end of the gripper support arm 108 extending through an aperture in the bag handling arm 106 and in the side opposing the portion of the gripper support arm 108 to which the gripper fingers 110 are attached.

The gripper timing pulley 144 is fixedly attached to the gripper support arm 108 by a locking collar 146 which is securely fastened to the side surface of the gripper timing pulley 144, and receives a threaded fastener 148 which securely engages the surface of the gripper support arm 108. The gripper support arm 108 extends through and is rotatingly carried within a roller bearing collar 150 mounted on and extending through an aperture in the bag handling arm 106. The gripper timing pulley 144 similarly defines a recessed channel 152 which receives the opposing end of the timing belt 142.

In this manner, as the drive shaft 126 rotates back and forth through a predetermined range of motion around its axis of rotation 154, the bag handling arm 106 will similarly pivot through a corresponding range in the same angular direction. The motion of the gripper support arm 108, because it is free to rotate about its axis of rotation 156 relative to the bag handling arm 106, will be constrained by the gripper timing belt 142, such that the orientation of the gripper fingers 110 relative to the frame assembly 16 will not change while the bag handling arm 106 and gripper support arm 108 pivot through their entire range of motion as shown in FIG. 4.

The gripper timing collar 136 and gripper timing pulley 144 define a plurality of teeth-like projections (not shown) which are spaced apart and engage corresponding projections 158 on the inner surface of the gripper timing belt 142. These interlocked projections 158 on the gripper timing belt 142 ensure that as the bag handling arm 106 pivots, the gripper timing belt 142 will not slip on the gripper timing collar 136 or gripper timing pulley 144, and the gripping fingers 110 will therefore remain in the proper predetermined alignment, preferably a generally vertical alignment as shown in FIG. 2.

The drive motor 122 and differential 124 may comprise any known rotary or reciprocatory drive assembly and include any of a variety of compatible mechanisms for converting the rotary or reciprocal motion imparted by the drive motor 122 into reciprocating rotary motion of the drive shaft 126, such as by the use of a pivoting cam, rack and pinion, or similar suitable mechanisms known to the art.

Referring to FIG. 3, it may be seen that drive shaft 126 extends through the housing of the differential 124 on the rear side opposing the bag handling arm 106 and gripper timing belt 142. The drive shaft 126 receives a generally circular drive sprocket 158 which is secured to the drive shaft 126 by a locking collar 160, the locking collar 160 being fixedly attached to the drive sprocket 160 in a manner similar to that described in reference to the locking collar 146 used in association with the gripper support arm 108 above.

The drive sprocket 158 has a plurality of peripheral gear teeth 164 designed to receive a continuous loop drive chain 166 thereon, the opposing end of the looped drive chain 166 encircling and engaging a plurality of gear teeth 168 of a drive wheel 170, the drive wheel 170 having a substantially larger diameter than the diameter of the drive sprocket 158.

Referring to FIG. 2, it may be seen that the drive wheel 170 is connected to a rocker bar 172 suspended at each end thereof from above by a pair of rocker bar supports 174. The rocker bar supports 174 are spaced apart, with each being fastened to the underside of an overhead portion of the frame assembly 16 and secured thereto with threaded fasteners 176.

The rocker bar 172 is slidably and rotatingly received within each of the rocker bar supports 174 such that the rocker bar 172 may pivot reciprocally back and forth about an axis of rotation 178 as the drive shaft 126, drive sprocket 158, and drive wheel 170 rotate in a reciprocatory manner.

Suspended from the rocker bar 172 and fixedly attached thereto with locking collars 180 of the type previously described are a pair of rocker arms 182 which receive the rocker bar 172 therethrough. The rocker arms 182 are spaced apart a distance greater than the lengths of each of the bags 40 and carry a generally planar bag support assembly 184 therebetween.

Referring to FIGS. 2 and 4, it may be seen that the bag support assembly 184 comprises an upper plate 186 pivotally connected to a lower plate 188 along the lower edge thereof by a hinge member 190 extending inwardly from each of the rocker arms 182 at each end of the lower plate 188. The end of the upper plate 186 is connected to a bracket 194 with a threaded fastener 196 which is received within an arcuate track 198 defined by and extending through the rocker arms 182.

By incorporating a straight track (not shown) defined by and extending through the lower plate 188 and receiving a threaded fastener 196 which fastens the lower plate 188 to a bracket 192, the track being aligned generally parallel with the viewing plane of FIG. 4, it is possible to adjust the lateral displacement of the lower plate 188 and the generally acute angle between the upper plate 186 and lower plate 188 or conveyor belt 200 using the threaded fasteners 196 which are received within the arcuate tracks 198 in the rocker arms 182.

It may be seen that as the rocker arms 182 pivot reciprocally, the bag support assembly 184 is carried to a position generally overlying and in close proximity to a conveyor belt 200. As shown in FIGS. 2 and 4, the conveyor belt 200 comprises a continuous loop of web material carried on a plurality of spaced apart conveyor drums 202, at least one such conveyor drum 202 having an axle 204 linked to a drive gear 206 having teeth 208 designed to receive a continuous loop drive chain 210, the opposing end of the drive chain 210 encircling and engaging a similar drive sprocket (not shown) which imparts the rotary force necessary to rotate the conveyor drum 202 and therefore move the conveyor belt 200.

The conveyor belt 200 includes a side retaining wall 212 comprised of a plurality of upwardly projecting rubber members 214 or a continuous bead which is cut or notched at several increments such that it will pass around the conveyor drum 202 with the conveyor belt 200. The side retaining wall 212 is positioned on the surface of the conveyor belt 202 at the side thereof nearest the bag carousel 12 and bag tray 38, as shown in FIG. 4.

In operation, a plurality of bags 40 may be placed in a stacked column or pile in each of the bag trays 38 as shown in FIG. 1. The carriage plate 18 is then preferably rotated in a counter clockwise direction to sequentially bring a first of the bag trays 38 into a bag pickup position adjacent to and closely confronting the bag handling apparatus as shown in FIG. 4. The brake pads 90 are then urged into frictional contact with the front and rear surfaces 44, 70 of the carriage plate 18, and the rotation of the drive shaft 126 is momentarily interrupted. The bag handling arm 106, gripper support arm 108, gripper fingers 110, and bag grippers 112 are pivoted to a first bag pickup position overlying the bag tray 38 as shown in Figures 1 and 4. In this bag pickup position, the gripper fingers 110 depend from the bag handling arm 106 such that the bag grippers 112 contact the planar surface of the top bag 40 of the stack in the bag tray 38. The vacuum pressure is then responsively applied to the bag grippers 112 such that they grip and hold the planar surface of the top bag 40. This vacuum pressure may be applied responsively to a signal provided by the switch 118 or other signalling means, or the vacuum pressure may be applied to the bag grippers at any time as the bag handling arm 106 approaches the bag pickup position.

Once the bag 40 has been gripped by the bag grippers 112, the bag handling arm 106 pivots upwardly and away from the bag tray 38 and bag carousel 14 carrying one bag 40 therewith, as shown in FIG. 4.

As the bag handling arm 106, gripper support arm 108, gripper fingers bag grippers 112, and bag 40 are pivoted away from the bag tray 38 and toward a second bag delivery position disposed over the conveyor 200 as shown in FIG. 2, the rocker arms 182 and bag support assembly 184 are pivoting inwardly and downwardly towards the bag tray 38 and side retaining wall 212 of the conveyor belt 200 and the longitudinal edge of the upper plate 186 connected to the hinge member 190 adjacent to and closely confronting the side retaining wall 212 of the conveyor belt 200.

As the bag 40 is lowered onto the upper plate 186 of the bag support assembly 184 from above by the bag handling arm 106, gripper support arm 108, gripper fingers 110, and bag grippers 112, the probe 120 of the switch 118 registers contact with the upper plate 186 and signals for the vacuum force applied to the bag grippers 112 to be responsively interrupted, thereby allowing the bag 40 to drop or slide onto and across the upper plate 186 of the bag support assembly 184 such that the longitudinal edge of the bag 40 contacts the side retaining wall 212 of the conveyor belt 200 in a parallel relation thereto as shown in FIG. 2.

The angle between the upper and lower plates 186, 188 of the bag assembly 184 may be adjusted such that bags constructed from various materials having different coefficients of friction relative to the upper plate 186 will slide into contact with the side retaining wall 212, and the lateral placement or position of the bag support assembly 184 may similarly be adjusted such that the bags of a particular size are dropped from the bag grippers 112 onto the upper plate 186 when the longitudinal edge of the bag 40 is immediately adjacent to the side retaining wall 212.

As the bag 40 is being transported to and placed on the bag support assembly 184 above the conveyor belt 200, the brake pads 90 release from the surfaces 44, 70 of the carriage plate 18, and the drive shaft 20 and carriage plate 18 are rotated to bring another bag tray 38 into the bag pickup position described above.

After the bag grippers 112 have released the bag 40, the bag handling arm 106 pivots back towards the bag pickup position to intercept the next bag tray 38 which is being or has been brought into the bag pickup position described above.

As the bag handling arm 106 pivots upwardly away from the bag support assembly 184 and then inwardly and downwardly towards the next bag tray 38, the rocker arms 182 and bag support assembly 184 pivot upwardly and outwardly away from the side retaining wall 212 and conveyor belt 200, thereby permitting the bag 40 to slide downwardly along the top planar surface of the upper plate 186 and be laid flat on the conveyor belt 200 as shown in Figure 1.

Because the drive wheel 170 is much larger than the drive sprocket 158, the drive wheel 170 and rocker bar 172 will rotate through a smaller angular path or range of degrees than the sprocket 158, drive shaft 126, or bag handling arm 106. Because the bag handling arm 106 is directly connected to the drive shaft 126 via a geared linkage including a drive sprocket 158, drive wheel 170, and drive chain 166, the rocker bar 172 and rocker arms 182 will necessarily pivot in the opposite direction of the movement of the bag handling arm 106 through the range of motion between the positions previously described.

The bag handling arm 106 and the rocker arms 182 and bag support assembly 184 may thus continue in the reciprocatory, scissoring movement described above, thereby transporting a series of bags 40 to and laying them on the conveyor belt 200: Depending upon the relative speeds of the conveyor belt 200, bag carousel 12, and bag handling mechanism 14, the bags 40 may be placed on the conveyor belt 200 in a spaced apart configuration or in an overlapping, fanned formation wherein a portion of each bag 40 is placed in contact with and on top of the previous bag 40, and a portion of that bag 40 will be in contact with and underlying the subsequent bag 40. As such, the spacing of each bag 40 relative to one another can be carefully controlled.

An operator may monitor the functioning of the machine and supply bags 40 to the bag trays 38 from a bag reserve as the bags 40 in each tray 38 are depleted, although it has proven preferable to employ an electrical logic control circuit to integrate the timing of the movement and operation of the bag handling mechanism 14 and bag carousel 12 in order to insure maximum operating efficiency.

It has also proven suitable to mount the bag trays 38 on a generally rectangular continuous loop chain carrier (not shown) rather than the carriage plate 18 as described above, although for optimal performance such an assembly requires that each bag tray 38 have a guide plate extending perpendicular to the planar surface 44 which is received within a narrow guide ramp to steady the bag tray 38 while the bag tray 38 is in the bag pickup position.

It is further understood that various choices from among those known to the art may be incorporated into the rotating carousel and bag handling apparatus 10 of this invention, such as employing an alternate drive or timing assembly for the bag carousel 12 or bag handling mechanism 14, keying the drive shaft 126, gripper support arm 108, or rocker bar 172 rather than using retaining collars 132, 146, 160, 180, and other interchangeable methods and techniques known to those skilled in the art of constructing such machines.

While the preferred embodiments of the rotating carousel and bag handling apparatus 10 of this invention have been described in detail above with reference to the attached drawings, it is understood that various changes and modifications may be made without departing from the spirit and scope of the appended claims.

What is claimed is:

1. A bag handling apparatus for transferring a bag from a tray containing a plurality of like bags to a predetermined position on a conveyor belt, said bag handling apparatus comprising:

a frame positionable generally proximate to both the tray and the conveyor belt;

a bag support assembly, said bag support assembly being mounted on said frame to move between a first support position displaced substantially over the conveyor belt and a second support position laterally displaced from said first support position relative to the conveyor belt;

a bag handling arm, said bag handling arm being mounted on said frame to move between a first position adjacent to the tray and a second position adjacent to said bag support assembly; and gripping means connected to said bag handling arm and capable of gripping the bag when said bag handling arm is in said first position adjacent to the tray and responsively releasing the bag when said bag handling arm is in said second position adjacent to said bag support assembly such that the bag may be transferred to and generally supported on said bag support assembly when the bag is released by said gripping means, whereby the gripping means grips the bag in the tray when the bag handling arm moves to the first position adjacent to the tray, the bag handling arm then moves to the second position adjacent the bag support assembly while carrying the bag therewith, the gripping means releases the bag onto the bag support assembly responsive to the bag handling arm reaching the second position, and the bag support assembly moves to the second support position thereby placing the bag at a predetermined position on the conveyor belt.

2. The bag handling apparatus of claim 1 wherein the bag handling arm is pivotably mounted to pivot between the first position adjacent to the tray and the second position adjacent to the bag support assembly.

3. The bag handling apparatus of claim 1 wherein the bag handling arm has a pair of opposing ends, said bag handling apparatus further comprising:

drive means for producing reciprocal rotary motion; and a drive shaft connected to said drive means and mounted to rotate reciprocally about an axis of rotation, one of the ends of the bag handling arm being connected to said drive shaft such that the bag handling arm pivots reciprocally as said drive shaft rotates reciprocally, the opposing end of the bag handling arm moving between the first position adjacent to the tray and the second position adjacent to the bag support assembly.

4. The bag handling apparatus of claim 3 wherein the bag handling arm further comprises:

a gripper support arm connected to and extending from the bag support arm generally perpendicular thereto, the gripping means being connected to said gripper support arm, at lease a portion of said gripper support arm overlying the tray when the bag handling arm is in the first position adjacent to the tray, and at least a portion of said gripper support arm overlying the bag support assembly when the bag handling arm is in the second position and the bag support assembly is in the first support position displaced substantially over the conveyor belt.

5. The bag handling apparatus of claim 4 wherein the gripping means comprises:

at least one suction cup connected to and depending from the gripper support arm;

vacuum means for producing a vacuum in said suction cup sufficient to grip and lift one of the bags.

6. The bag handling apparatus of claim 1 wherein the gripping means comprises:

at least one suction cup connected to and depending from the gripper support arm, said suction cup being connected to the bag handling arm such that said suction cup contacts the surface of the bag in the tray when the bag handling arm is in the first position adjacent the tray;

vacuum means for producing a vacuum in said suction cup sufficient to grip and lift one of the bags.

7. The bag handling apparatus of claim 6 further comprising:

switch means, said switch means being electrically connected to said vacuum means and capable of producing a signal responsive to the bag handling arm reaching to the second position adjacent to the bag support means with the bag support means generally overlying the conveyor belt, said signal causing the vacuum to be interrupted so as to release the bag from the suction cup.

8. The bag handling apparatus of claim 7 wherein the switch means has a movable filament projecting therefrom, said filament capable of contacting or being moved by the bag support assembly when the bag handling arm is in the second position adjacent the bag support assembly, the switch means producing the signal in response to contact between said filament and the bag support assembly.

9. The bag handling apparatus of claim 1 further comprising:

a gripper support arm rotatably connected to and extending from the bag support arm generally perpendicular thereto, the gripping means being connected to said gripper support arm in a generally depending orientation relative to the frame and said gripper support arm, at least a portion of said gripper support arm overlying the tray when the bag handling arm is in the first position adjacent to the tray, and at least a portion of said gripper support arm overlying the bag support assembly when the bag handling arm is in the second position and the bag support assembly is in the first support position displaced substantially over the conveyor belt, said gripper support arm being mounted to rotate about an axis of rotation relative to the bag handling arm; and means for preserving the generally depending orientation of the gripper means relative to the frame and said gripper support arm as the bag handling arm moves between the first position adjacent the tray and the second position adjacent the bag support assembly.

10. The bag handling apparatus of claim 9 wherein the means for preserving the generally depending orientation of the gripper means comprises:

a timing belt, said timing belt forming a continuous loop and being carried on and engaging at least a portion of the gripper support arm; and a timing collar carrying and engaging at least a portion of said timing belt, said timing collar being mounted on said frame such that said timing collar does not rotate.

11. The bag handling apparatus of claim 10 wherein the bag handling arm has a pair of opposing ends, said bag handling apparatus further comprising:

drive means for producing reciprocal rotary motion; and a drive shaft connected to said drive means and mounted to rotate reciprocally about an axis of rotation, one of the ends of the bag handling arm being connected to said drive shaft such that the bag handling arm pivots reciprocally as said drive shaft rotates reciprocally, the opposing end of the bag handling arm moving between the first position adjacent to the tray and the second position adjacent to the bag support assembly.

12. The bag handling apparatus of claim 11 wherein the timing collar defines a bore extending therethrough, the timing collar being positioned between the drive means and the bag handling arm and such that said bore receives the drive shaft therethrough.

13. The bag handling apparatus of claim 10 further comprising:

a timing pulley, said timing pulley being connected to the gripper support arm so as to rotate with the gripper support arm, said timing pulley engagingly receiving the timing belt thereon.

14. The bag handling apparatus of claim 1 further comprising:

a carousel, said carousel being mounted on the frame for rotational motion about an axis of rotation, the tray being mounted on said carousel such that said tray is carried to a position adjacent to the bag handling arm when the bag handling arm is in the first position.

15. The bag handling apparatus of claim 14 wherein the carousel is a generally circular plate oriented in a generally vertical plane such that the axis of rotation of the carousel is in a generally horizontal plane.

16. The bag handling apparatus of claim 14 wherein a plurality of like trays are mounted on the carousel, each of said like trays containing the plurality of like bags and being successively carried to the position adjacent to the bag handling arm when the bag handling arm is in the first position as the carousel rotates about the axis of rotation.

17. The bag handling apparatus of claim 14 further comprising:

means for maintaining the tray in a generally constant orientation relative to the frame as the carousel rotates about the axis of rotation.

18. The bag handling apparatus of claim 1 wherein the conveyor belt is oriented generally horizontally, and wherein bag support assembly comprises:

an upper plate, said upper plate being mounted for pivotal movement relative to the conveyor belt, said upper plate having a planer top surface oriented at a generally acute angle relative to the conveyor belt such that the bag will slide downwardly along said top planar surface and be laid flat on the conveyor belt as the bag support assembly is pivoted to the second support position laterally displaced from the conveyor belt.

19. The bag handling apparatus of claim 18 wherein the plate is mounted between and connected to a pair of rocker arms, each said rocker arm mounted to said frame for pivotal movement relative thereto.

20. A bag handling apparatus for transferring a bag selected from a supply of like bags to a predetermined position on a conveyor belt, said bag handling apparatus comprising:

a frame positionable generally proximate to the conveyor belt;

a carousel mounted on said frame for rotation about an axis of rotation;

a plurality of trays, said trays being mounted on and carried by said carousel, each said tray containing a plurality of the like bags;

a bag support assembly, said bag support assembly being mounted on said frame to move between a first support position displaced substantially over the conveyor belt and a second support position laterally displaced from said first position relative to the conveyor belt;

gripping means connected to said bag handling arm and capable of gripping the bag when said bag handling arm is in said first position adjacent to one of said trays and responsively releasing the bag when said bag handling arm is in said second position adjacent to said bag support assembly such that the bag may be transferred to and generally supported on said bag support assembly when said gripping means is released, whereby the carousel rotates to bring the trays sequentially to the first position adjacent the bag handling arm, the gripping means grips the bag within the tray rotated to the first position adjacent the bag handling arm, the bag handling arm then moves to the second position adjacent to the bag support assembly while carrying the bag therewith, the gripping means releases the bag onto the bag support assembly responsive to the bag handling arm reaching the second position, and the bag support assembly moves to the second support position thereby placing the bag at a predetermined position on the conveyor belt.

* * * * *

UNITED STATES PATENT AND TRADEMARK OFFICE

CERTIFICATE OF CORRECTION

PATENT NO. : 4,884,389

DATED : December 5, 1989

INVENTOR(S) : Harold R. McGregor

It is certified that error appears in the above-identified patent and that said Letters Patent is hereby corrected as shown below:

At column 14, line 2 (claim 20), after "to the conveyor belt;" insert a new paragraph that reads --a bag handling arm, said bag handling arm being mounted on said frame to move between a first position adjacent to the tray and a second position adjacent to said bag support assembly; and--.

Signed and Sealed this

Eighth Day of September, 1992

*Attest:*

DOUGLAS B. COMER

*Attesting Officer*

*Acting Commissioner of Patents and Trademarks*